United States Patent [19]

Stevens, Sr. et al.

[11] 4,043,036

[45] Aug. 23, 1977

[54] POWER DRIVEN SHAVER

[75] Inventors: Richard N. Stevens, Sr., Placentia; Clarence R. Possell, San Diego; Robert J. Winkler, Santa Ana, all of Calif.

[73] Assignee: Alpha Nova Development Corporation, Santa Ana, Calif.

[21] Appl. No.: 763,001

[22] Filed: Jan. 27, 1977

[51] Int. Cl.[2] ..... B26B 19/16

[52] U.S. Cl. ..... 30/43.6; 30/42; 30/276

[58] Field of Search ..... 30/42, 43.4, 43.5, 43.6, 30/276

[56] References Cited

U.S. PATENT DOCUMENTS

| | | | |
|---|---|---|---|
| 2,524,822 | 10/1950 | Neidig | 30/43.6 |
| 2,616,167 | 11/1952 | Scheponick | 30/43.6 |
| 3,027,507 | 3/1962 | Hubner | 30/43.6 X |
| 3,047,944 | 8/1962 | Bulova | 30/43.6 |
| 3,245,145 | 4/1966 | Buford | 30/43.5 |

FOREIGN PATENT DOCUMENTS

| | | | |
|---|---|---|---|
| 532,087 | 8/1955 | Italy | 30/43.6 |
| 39,261 | 7/1907 | Switzerland | 30/42 |
| 236,448 | 6/1945 | Switzerland | 30/43.6 |

*Primary Examiner*—Gary L. Smith

*Attorney, Agent, or Firm*—William C. Babcock

[57] ABSTRACT

A power driven shaver of the type that includes a housing that has a prime mover therein, with one end of the housing supporting a transverse thin curved shield. The shield has a number of longitudinally and circumferentially spaced slots therein that are of such dimension that whiskers may extend therethrough. A number of helical shaped blades are rotated by the prime mover in close proximity to the interior surface of the shield, with the blades serving to sever inwardly projecting portions of the whisker by a rotating slicing action. The present power driven shaver is free of vibration, and exerts no uncomfortable pulling action on whiskers as they are severed, or the whiskers as they are cut are not compressed or pinched.

2 Claims, 8 Drawing Figures

FIG.1
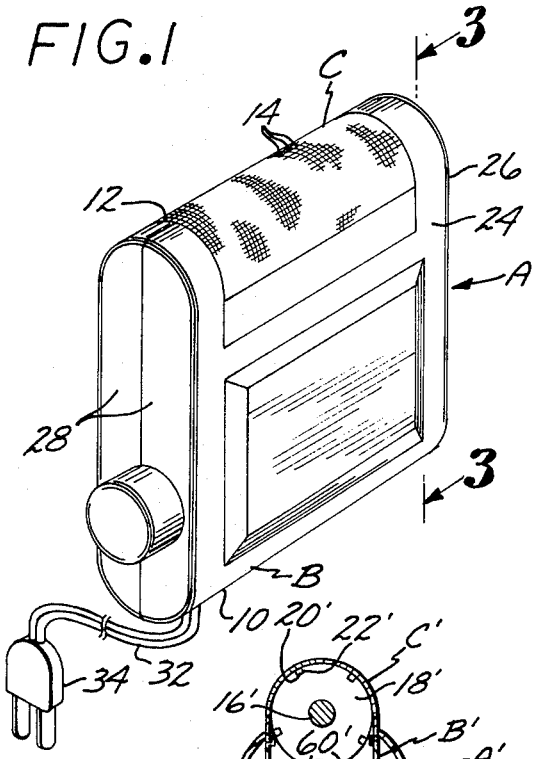
FIG.4
FIG.2
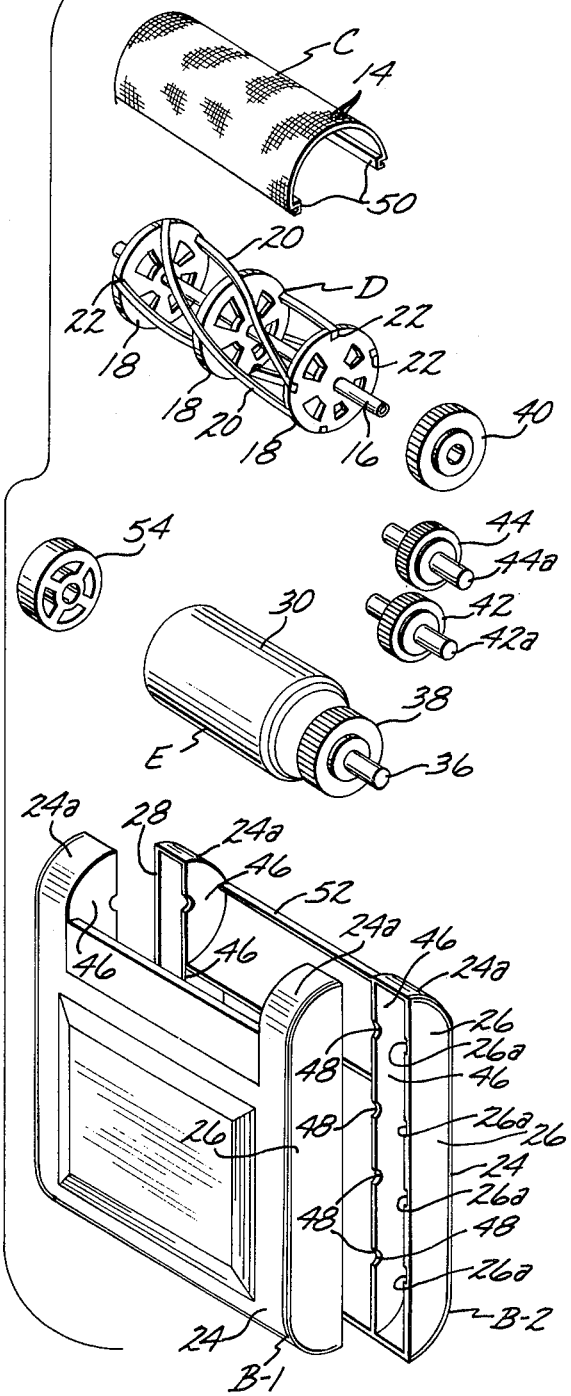
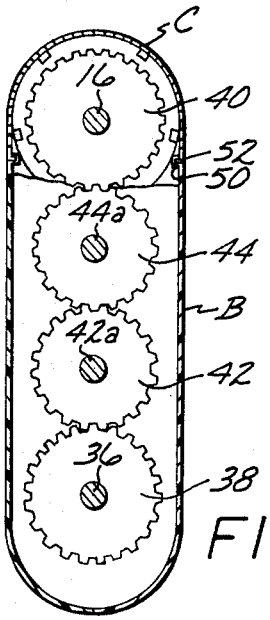
FIG.3

POWER DRIVEN SHAVER

BACKGROUND OF THE INVENTION

1. Field of the Invention

A power driven shaver.

2. Description of the Prior Art

The present day power driven razors operate in substantially the same manner, even though in some instances the blades may be reciprocated and in others rotated. The motion of the cutting edge of the blade is normal to longitudinal axis of the whisker being cut and as a result due to this type of movement of prior art blades, the whiskers as they are cut must be compressed or pinched between the cutting edge of the blade and the stationary apertured body through which the whisker extends, and this action imparting a pull on the whisker or hair that is very uncomfortable and making it difficult to obtain a close shave without repeatedly going over the same area.

In addition when a prior art razor is of the reciprocating type, substantial noise is emitted from the device due to the stopping and starting of the reciprocating blade mechanism, and also the reciprocating motion imparting vibration to the power driven razor and that is unpleasant to many users. A major object of the present invention is to provide a power driven razor in which whiskers or hairs to be cut extend through an apertured shield that forms a part of the device, with the inward blade projecting portions of the whiskers or hairs being cut by a rotary slicing action, and the present invention not only being free of vibration but exerting no uncomfortable pulling action on the whiskers or hairs as they are cut.

SUMMARY OF THE INVENTION

The invention includes a housing having first and second ends, with the second end being open and removably closed by a transversely curved aperture shield that is removably supported on the housing. A transversely extending shaft is rotatably supported in the housing adjacent the second end with the shaft having a number of longitudinally spaced circular plates secured thereto, and the plates serving to support a number of helical blades that are secured to the peripheries thereof. A prime mover is situated in the housing adjacent the first end, and may be either electrically operated by domestic current or batteries or if desired the prime mover may be a spring-actuated device. The prime mover, irrespective of the type thereof, by gear transmission means causes the shaft, plates, and helical blades to rotate. The blades, as they rotate, sequentially move into close proximity into the interior surface of the shield, and sever hairs or whiskers projecting inwardly through the apertures, and the cutting of the hairs or whiskers being by a rotary slicing action. The invention above-described is free of vibration and exerts no appreciable pull on the hair or whiskers being cut dut to the cutting being by a slicing action, rather than the hairs or whiskers being cut by squeezing or compressing sections of the whiskers or hairs.

BRIEF DESCRIPTION OF THE DRAWINGS

FIG. 1 is a perspective view of a power driven shaver;

FIG. 2 is an exploded perspective view of the components that comprise the device illustrated in FIG. 1;

FIG. 3 is a transverse cross-sectional view of the device shown in FIG. 1 taken on the line 3—3 thereof;

FIG. 4 is a transverse cross-sectional view of a first alternate form of the power-driven shaver that is actuated by a battery-powered prime mover;

DESCRIPTION OF THE PREFERRED EMBODIMENT

Figure 5:
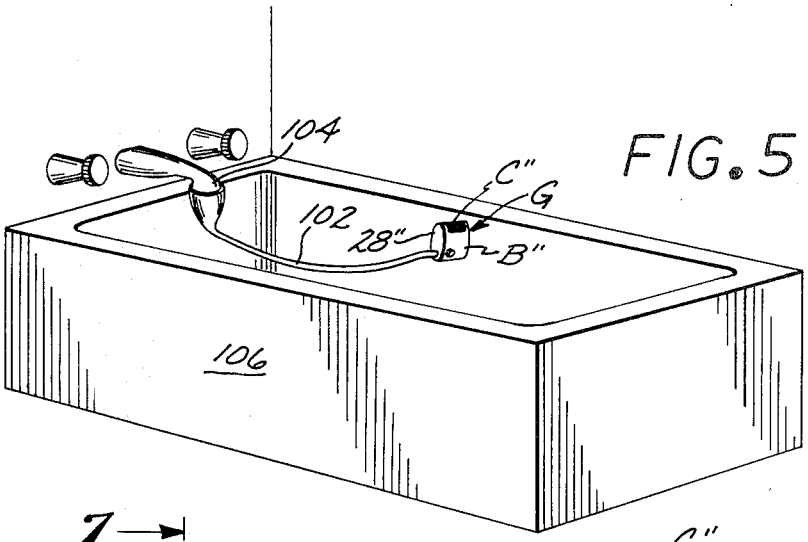
FIG. 5 is a perspective view of a third alternate form of shaver that is water-powered and may be used in a bathtub without danger of electric shock.
Figure 6:
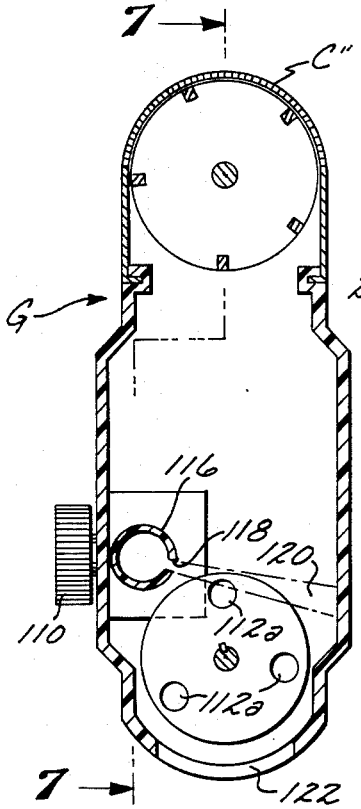
FIG. 6 is a transverse cross-sectional view of the device shown in FIG. 5.
Figure 7:
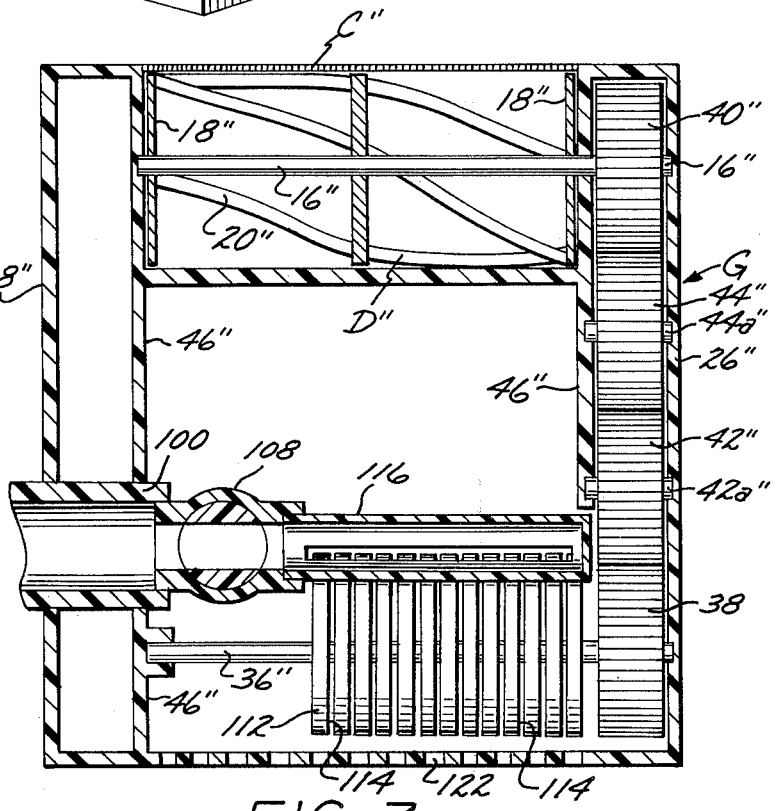
FIG. 7 is a cross-sectional view of the device shown in FIG. 6 taken on the line 7—7 thereof.
Figure 8:
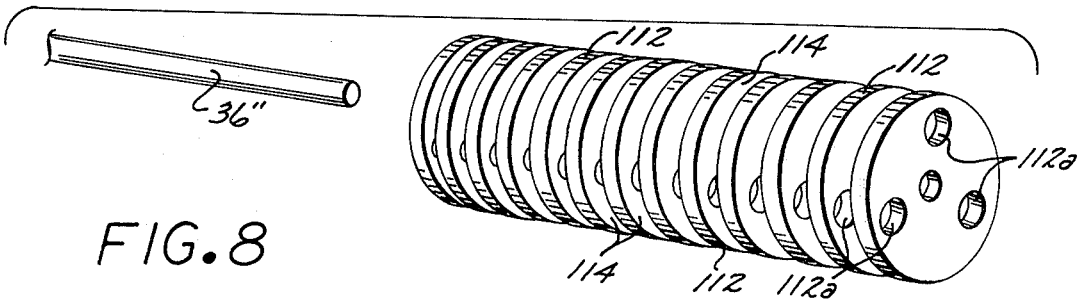
FIG. 8 is an exploded perspective view of the bladeless turbine used in actuating the second alternate form of shaver.

A first form of the power-driven shaver A is shown in FIG. 1 and includes a housing B that has a closed first end 10 and a second open end 12. A thin shield, generally semicylindrical in shape, is provided with the shield having a number of longitudinally and circumferentially spaced elongate slots 14 defined therein, each slot being of such dimension that a hair or a whisker may extend inwardly therethrough. A cutting real assembly D is provided that is best seen in FIG. 2. The cutting real assembly D includes a shaft 16 of substantial length that has a number of circular plates 18 rigidly secured there in longitudinally spaced relationship to one another. A number of elongate helical blades 20 are provided that are disposed in slots 22 formed in the periphery of the plates 18.

The housing B includes a pair of side walls 24 and first and second end walls 26 and 28. The housing B is illustrated in FIG. 1 and FIG. 2 as being of split construction, and defined by first and second engaging sections B-1 and B-2 that are either bonded together at their abutting edges or removably secured to one another by fastening means of a conventional design (not shown). The housing A served to support a prime mover D within the interior of and adjacent of the first closed end 10. The prime mover D in FIGS. 1 and 2 is illustrated as an electric motor that is supplied power through a pair of insulated conductors 32 that have a prong plug of conventional design mounted on the free end thereof. The plug 34 is adapted to be removably inserted in a domestic outlet (not shown). The prime mover D is illustrated as including a projecting driving shaft 36 that has a driving gear 38 secured thereto. A driven gear 40 is mounted on the shaft 16 and is disposed adjacent of the first end wall 26 of the housing, and in alignment with the driving gear 38. First and second idling gears 42 and 44 are provided that have first and second shafts **42*a* and 44*a* extending transversely through the centers thereof. The first and second shaft 42*a* and 44*a* have end portions thereof mounted in interior recesses 26*a* formed in the first end wall 26. The housing B includes an interal rib 46 that is adjacently disposed to the first end wall 26, with a rib having a number of openings 48** therein.

The free longitudinal edges of the shield C as may best be seen in FIGS. 2 and 3 developed into longitudinally extending channel shaped members 50 that removably interlock with libs 52 formed on the second end of the housing B. When the housing B is of the split structure as shown in FIG. 2, the opening 48 in which the shaft **16, 42*a*, 44*a* and 36 are defined by semicircular openings in the abutting edges of the rib 46. Housing B has a rotatable handle 54 projecting from the second end walls 28 thereof as shown in FIG. 1 which handle when rotated accurates a rheostat or potentiometer (not shown) to control the speed at which the electric motor 30 operates. The pair of side walls 24 have curved upward extension 24***a* which in combination with the pair of ribs 46 curved to conceal the end of the real assembly D when the latter is rotatably supported in the housing B in close proximity to the interior surface of the shield C. The use and operation of the first form A of the power driven shaver is extremely simple. When the motor 30 is actuated, it drives the gear 38, which in turn causes the idling gears 42 and 44 to rotate the driving gear 40 secured to shaft 16. The reel assembly D is rotated at a substantial speed in close proximity to the interior surface of the shield C. Hairs or whiskers (not shown) that extend through the slot 14 are severed by coming into rotatable slicing contact with the helical blades 20 as the latter rotates. Severed whiskers or hairs (not shown) are removed from the first form A of the shaver by removing the shield C therefrom, and shaking the shaver with the second open end 12 in a downwardly disposed position. The shield C may then be replaced on the first form of shaver A as shown in FIG. 1.

A second form of power driven shaver A′ shown in FIG. 4 has the same general interior structure as the first form A, but in which the electric motor 30′ is energized by electric power from a pair of batteries 56. Elements in the second form A′ of the invention that are common to the first form A are identified by the same numerals and letters previously used but to which primes have been affixed. The side walls 24′ as may be seen in FIG. 4 have convex grips 58 secured thereto with these grips imparting a generally pear-shape configuration to the power-driven shaver A′. The electric motor 30′ has a driving shaft 36′ which actuates the idling gears 42, 44, and driven gear 40, which gears are not shown, in the same manner as in the first form A of the invention. Electric power to the motor 30′ is supplied from a pair of batteries 56 that are held in the housing B′ by a pair of clips 60′. Electric power from the battery 60′ flows to the electric motor 30′ through a pair of electrical conductors 60. The second form A′ of the power-driven shaver operates in the same manner as the first form A and produces the same result. Accordingly, the description and manner of operation of the second form A′ of the power-driven shaver may be dispensed with, inasmuch as this operation has been previously described in conjunction with the first form A. Should it be desired, the electric motors 30 and 30′ may be replaced with a spring-operated motor (not shown).

From the above description it will be seen that if the prime mover rotates at, say 1250 revolutions per minute and there are five blades on the reel, the cutting effect of the blades is the same as if a single blade were rotating at 6250 revolutions. Thus, in using the invention, there is no possibility that the invention may be moved so rapidly that a whisker or hair that projects into the interior of the invention will not be cut with a slicing motion by one of the blades.

A third alternate form G of the invention is shown in FIGS. 5 to 8 inclusive, and differs from the first form A in that the third alternate form is powered with pressurized water from a domestic source. The use of pressurized water in the third form G permits the invention to be used in a bath tub without the user being subjected to the hazard of an electric shock. Elements of the third form G of the invention common to the first form A are identified by the same numerals and letters previously used but have double primes added thereto.

In the third alternate form G a tubular member 100 extends into the interior of the housing B, and is adapted to be connected by conventional means to a flexible hose 102 to a faucet 104 in a bath tub 106 as shown in FIG. 5. Tubular member 100 on its inner end is connected to a valve 108 that is manually actuable by a handle 110 disposed exteriorly of the housing B.

The shaft 36″ has a number of turbine discs 112 rigidly secured thereto and the discs having circular spaces 114 therebetween. The discs 112 have a number of circumferentially spaced, longitudinally aligned ports 112*a* therein. A tubular header 116 that is parallel to shaft 36″ is secured to valve 108, and is adjacently disposed to the peripheries of the turbine discs 112. The header 116 has a number of apertures 118 therein that are aligned with the spaces 114. The apertures have pressurized water discharging therefrom in the form of jets 120 a direction tangential to the spaces 114.

The pressurized jets of water 120 upon entering the outer portion of spaces 114 loses velocity due to the drag imposed by frictional contact with the turbine discs 112, with the pressure on the water increasing as the jets thereof lose velocity. This increased pressure on the water forces it radially inward relative to the turbine discs 112, with the water escaping therefrom through openings 122 in the casing B″ adjacent the turbine discs. The rate of flow of water to the header 116 is controlled by the manipulation of valve 108. The use and operation of the third alternate form G is the same as form A of the invention. The third alternate form G of the shaver may be employed safely in a bath tub where the use of form A of the shaver under such conditions would be hazardous from an electric shock standpoint.

The use and operation of the invention has been described previously in detail and need not be repeated.

We claim:

1. A power driven shaver of the type that includes a housing that has a first closed end and a second open end, said housing including a pair of side walls and first and second end walls; a semi-cylindrical thin shield mounted on said housing and closing said second end, said shield having a plurality of longitudinally spaced, circumferentially extending slots therein; a prime mover mounted in said housing adjacent said first end; said prime mover being a plurality of turbine discs that rotate in said housing on a common longitudinal axis, said discs having a plurality of circumferentially spaced longitudinally aligned openings therein; a driving gear in said housing that is rotated by said prime mover; said power driven shaver being characterized by including:

a. a cutting reel assembly that comprises:
   1. a first shaft that has first and second end portions;
   2. a plurality of circular plates rigidly secured to said first shaft and occupying longitudinally spaced positions between said first and second end portions;
   3. a plurality of elongate resilient cutting blades of helical shape that are removably supported in longitudinally extending, circumferentially spaced relationship on said plates in a plurality of slots formed in said plate; and 4. a driven gear mounted on said first end portion of said first shaft, b. first means in said housing adjacent said first and second walls for rotatably supporting said first and second end portions of said shaft, with said cutting blades when said reel is rotated sequentially moving circumferentially relative to said shield and adjacently disposed to the interior surface thereof;

c. idling gear means in said housing disposed between said driving gear and driven gear and in toothed engagement therewith;

d. second means for rotatably supporting said idling gear means in said housing;

e. third means manually adjustable from the exterior of said housing for controlling the speed of said prime mover and reel driven thereby, with said shaver when said shield is moved across the face of a user shaving said user due to whiskers of said user sequentially moving through said slots and being severed by slicing rotatable contact with said blades as said reel rotates;

f. a header disposed in said housing adjacent said turbine discs, said header having a plurality of apertures therein through which jets of water discharge into spaces between said discs, said jets of water losing velocity due to the frictional drag on said discs as the latter are rotated, with the pressure on said water increasing to force said water inwardly to flow through said openings, and said water after discharging from said openings flowing through openings in said housing;

g. a flexible hose connected to said header; and, h. connection means for connecting said hose to a source of pressurized water.

2. A power driven shaver as defined in claim 1 which in addition includes:

i. a partition in said housing that prevents water in said housing that powers said turbine discs contacting said cutting reel assembly.

* * * * *